United States Patent [19]

Assum et al.

[11] Patent Number: 4,822,960

[45] Date of Patent: Apr. 18, 1989

[54] ROTARY CODING SWITCH

[75] Inventors: Rudolf S. Assum, Nürnberg; Franz Sczepur, Erlangen, both of Fed. Rep. of Germany

[73] Assignee: Alcatel N.V., Amsterdam, Netherlands

[21] Appl. No.: 95,188

[22] Filed: Sep. 11, 1987

[30] Foreign Application Priority Data

Sep. 18, 1986 [DE] Fed. Rep. of Germany ..... 3631722

[51] Int. Cl.[4] ..... H01H 19/60

[52] U.S. Cl. ..... 200/11 R; 200/11 G; 200/564

[58] Field of Search ..... 200/11 R, 11 A, 11 B, 200/11 C, 11 D, 11 DA, 11 E, 11 EA, 11 G, 11 H, 11 J, 11 K, 11 TC, 11 TW, 153 M, 164 R, 46

[56] References Cited

U.S. PATENT DOCUMENTS 4,551,587 11/1985 Rose ..... 200/11 R

FOREIGN PATENT DOCUMENTS 42564 12/1965 German Democratic Rep. ... 200/11 R

*Primary Examiner*—A. D. Pellinen
*Assistant Examiner*—Morris Ginsburg
*Attorney, Agent, or Firm*—Spencer & Frank

[57] ABSTRACT

A rotary coding switch is disclosed which comprises a rotor or a rotor and a coding disk provided with coding recesses for actuating the contacts. Each contact spring is provided with a boss cooperating with associated coding recesses which, in the open state of the contact spring, engages one of the associated coding recesses under pretension of the contact spring, and which is moved to the position corresponding to the closed state of the contact spring via the boss being contacted by the surface of the rotor or the coding disk remaining between the coding recesses.

14 Claims, 1 Drawing Sheet

ROTARY CODING SWITCH

BACKGROUND OF THE INVENTION

1. Field of the Invention

The present invention relates to a rotary coding switch and specifically a miniature rotary coding switch.

2. Discussion of the Prior Art

U.S. Pat. No. 4,145,585 discloses a pulse switch in which a contact spring provided with a contact portion that is lifted off the opposite contact by means of cams located at the rotor.

In the coding switch disclosed in U.S. Pat. No. 3,665,127, the contacts slide continuously on a rotor plane provided with contact and insulating paths. It is also known to lift the contacts by means of an insulating disk with coding recesses if the portions between the recesses come to lie under the contact member. In this case, the contact member also slides on the opposite contact or on the insulating disk.

SUMMARY OF THE INVENTION

It is the object of the present invention to eliminate sliding of the contact members and to still ensure that good contact is made.

This object is achieved by providing a rotor or coding disk which includes coding recesses and providing the movable contacts with a boss thereon which is displaceable into a coding recess. The circuit is completed for a first contact by the surface of the rotor or the coding disk containing the coding recesses contacting the boss of the first contact and forcing it to contact a second contact.

A first contact is lifted completely off a second contact and no contact is made when the boss engages a coding recess, thus defining an open state of the first contact. The closed state is defined when the first contact is urged against the second contact by pressure applied to the first contact by the rotor or the coding disk surface.

BRIEF DESCRIPTION OF THE DRAWINGS

Further advantageous details of the invention are set forth in below and will now be described with reference to the accompanying drawings, which show a preferred embodiment of the invention, and in which.

DETAILED DESCRIPTION OF THE PREFERRED EMBODIMENT

Figures 1, 2, 3, 4, 5:
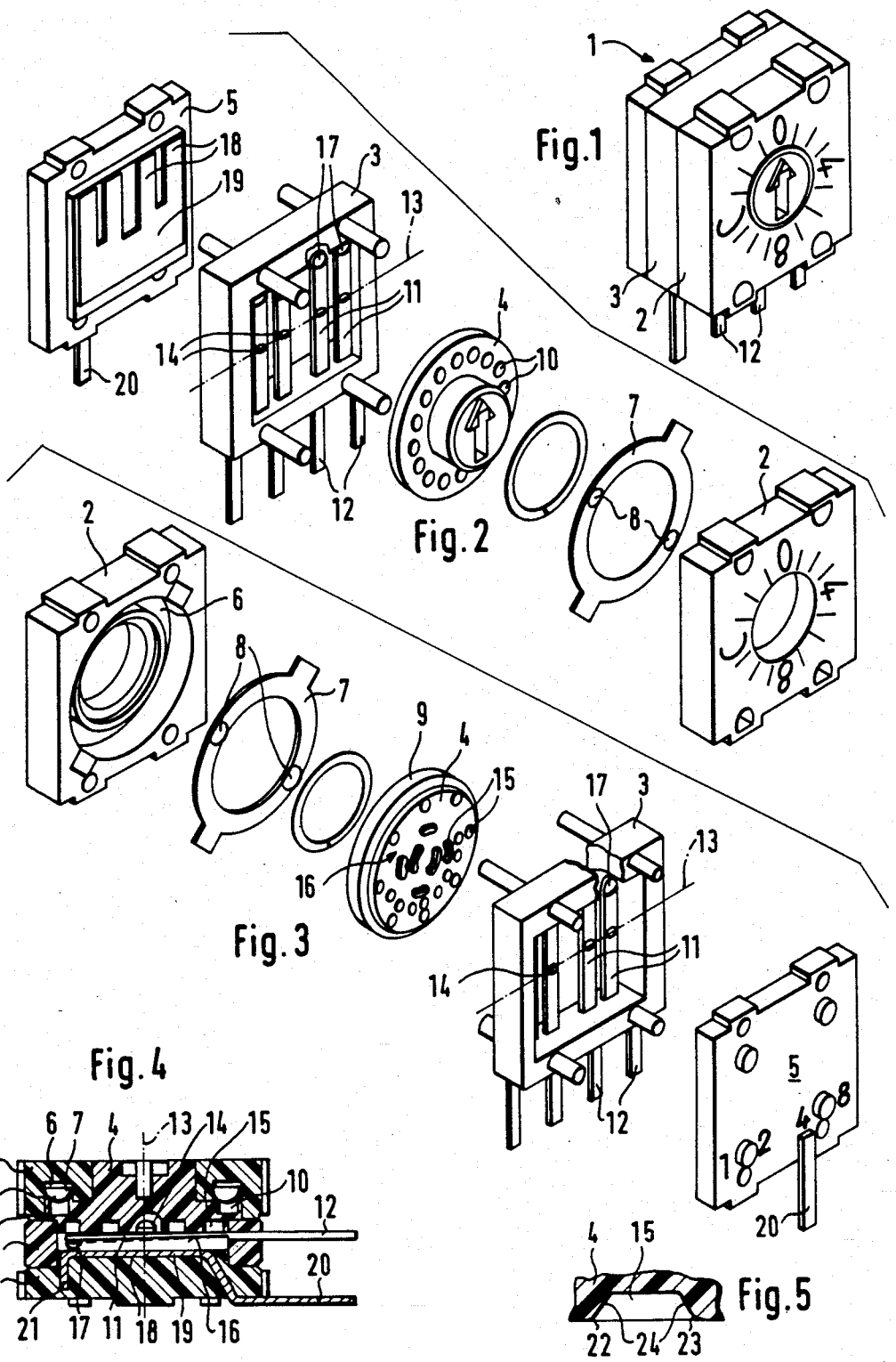
FIG. 1 shows a rotary switch, designed as a coding switch.
FIG. 2 is an exploded perspective view of the switch of FIG. 1, seen from the front.
FIG. 3 is an exploded perspective view of the switch of FIG. 1, seen from behind.
FIG. 4 is a cross section of the switch of FIG. 1, seen from the side.
FIG. 5 shows a sideview of a part of the rotor disk with a coding recess.

The reference numeral 1 designates a miniature rotary switch which is designed as a coding switch. It comprises a rotor 4 rotatably mounted between a top part 2 of the housing and a contact frame 3, and a bottom part 5 of the housing.

On the inside of the top part 2, there is an annular groove 6 into which is placed a locking spring 7 with surface irregularities formed as detent bosses 8. The backing spring 7 is designed as a resilient locking ring. The detent bosses 8 press from above on a flange 9 of the rotor 4. The flange 9 is provided with locking holes 10 at angular distances corresponding to the desired indexing positions of the rotary switch. The flange 9 lies on the contact frame 3 on the side not facing the top part 2. Additional surface irregularities such as locking elevations may be provided instead of, or between, the locking holes 10.

The contact frame 3 is provided with four parallel contact springs 11, whose contact terminals 12 are molded or plugged into the contact frame and are fixed in position therein. On the common center line 13, each contact spring is provided with a boss formed as a hemispherically shaped cap by means of a ball indentation. The bosses 14 can cooperate with coding recesses 15 in the underside 16 of the rotor 4 by engaging them so that the corresponding contacts 17 at the end portions of the contact springs 11 do not make contact with the opposite contacts 18 provided in the bottom part 5. The coding recesses 15 can also be provided on a separate disk which is rigidly connected or coupled to the rotor 4. Together with the coding recesses 15, the bosses 14 can serve as an index mechanism for the switch 1.

In the bottom part 5, tongue-shaped opposite contacts 18 are formed on a common contact plate 19 whose contact terminal 20 is molded in the bottom part 5. The free ends 21 of the opposite contacts 18 are bent downward and are also molded in the bottom part 5.

To achieve easy running of the switch between the bosses 14 and the coding recesses 15, the entry and exit edges 22 and 23 of the coding recesses 15 are rounded and, if necessary, the contiguous walls 24 are inclined inwardly.

We claim:

1. A rotary coding switch comprising:

a housing having a top part and a bottom part;

a contact frame disposed between said top and bottom parts;

a plurality of first contacts connected to and supported in said contact frame, each of said first contacts including a boss provided thereon;

a plurality of second contacts supported in said bottom part of said housing; and a rotor means rotatably mounted between said top part and said contact frame, said rotor means including an underside surface which faces said first contacts and contains means defining a plurality of coding recesses;

whereby in operation of said switch, an open state of a respective first contact is defined by the boss of said respective first contact engaging in an associated coding recess in said rotor means under a normal first contact tension and a closed state of said respective first contact is defined by the underside surface of said rotor means contacting the boss of said respective first contact thereby forcing a portion of said respective first contact to contact a respective second contact.

2. A rotary coding switch as defined in claim 1, wherein said rotor means with said coding recesses and said first contacts with said bosses comprise an index mechanism for said switch.

3. A rotary coding switch as defined in claim 1, further comprising a locking spring disposed adjacent to said top part of said housing, said locking spring includes means defining surface irregularities therein and wherein said rotor means further includes a surface which faces said locking spring that also contains means defining surface irregularities therein so that said surface irregularities on said rotor means can engage said surface irregularities on said locking spring.

4. A rotary coding switch as defined in claim 1, wherein said bosses on said first contacts are hemispherical in shape.

5. A rotary coding switch as defined in claim 1, wherein said coding recesses include entry and exit edges which are rounded in shape.

6. A rotary coding switch as defined in claim 1, wherein said coding recesses include entry and exit edges and a wall connected to at least one of said entry and said exit edges which is inwardly inclined.

7. A rotary coding switch comprising:

a housing having a top part and a bottom part;

a contact frame disposed between said top and bottom parts;

a plurality of first contacts connected to and supported in said contact frame, each of said first contacts including a boss provided thereon;

a plurality of second contacts supported in said bottom part of said housing;

a rotor means rotatably mounted between said top part and said contact frame, said rotor means including an underside surface which faces said first contacts; and a coding disk adjacent said underside surface of said rotor means which contains means defining a plurality of coding recesses;

whereby in operation of said switch, an open state of a respective first contact is defined by the boss of said respective first contact engaging in an associated coding recess in said coding disk under a normal first contact tension and a closed state of said respective first contact is defined by a surface of said coding disk contacting the boss of said respective first contact thereby forcing a portion of said respective first contact to contact a respective second contact.

8. A rotary coding switch as defined in claim 7, wherein said rotor means and said coding disk are rigidly connected together.

9. A rotary coding switch as defined in claim 7, wherein said rotor means and said coding disk are integrally formed as a unit.

10. A rotary coding switch as defined in claim 7, wherein said coding disk with said coding recesses and said first contacts with said bosses comprise an index mechanism for said switch.

11. A rotary coding switch as defined in claim 7, further comprising a locking spring disposed adjacent to said top part of said housing, said locking spring includes means defining surface irregularities therein and wherein said rotor means further includes a surface which faces said locking spring that also contains means defining surface irregularities therein so that said surface irregularities on said rotor means can engage said surface irregularities on said locking spring.

12. A rotary coding switch as defined in claim 7, wherein said bosses on said first contacts are hemispherical in shape.

13. A rotary coding switch as defined in claim 7, wherein said coding recesses include entry and exit edges which are rounded in shape.

14. A rotary coding switch as defined in claim 7, wherein said coding recesses include entry and exit edges and a wall connected to at least one of said entry and said exit edges which is inwardly inclined.

* * * * *